United States Patent [19]

Smith

[11] Patent Number: 4,723,327

[45] Date of Patent: Feb. 9, 1988

[54] PATIENT MOVER

[76] Inventor: Walter J. Smith, 1738 Eastbrook Rd., New Castle, Pa. 16101

[21] Appl. No.: 37,183

[22] Filed: Apr. 10, 1987

[51] Int. Cl.[4] ..... A61G 7/08

[52] U.S. Cl. ..... 5/82 R; 5/89

[58] Field of Search ..... 5/61, 81 R, 81 B, 82 R, 5/89, 496; 294/140, 150, 152

[56] References Cited

U.S. PATENT DOCUMENTS

| | | | |
|---|---|---|---|
| 1,334,901 | 3/1920 | Higdon . | |
| 3,829,914 | 8/1974 | Treat | 5/82 R X |
| 3,884,225 | 5/1975 | Witter | 128/33 |
| 4,283,068 | 8/1981 | Keyser | 5/82 R X |
| 4,536,903 | 8/1985 | Parker | 5/61 |

FOREIGN PATENT DOCUMENTS

| | | | |
|---|---|---|---|
| 468336 | 7/1937 | United Kingdom | 5/82 |
| 547995 | 7/1942 | United Kingdom | 5/82 |

*Primary Examiner*—Alexander Grosz
*Assistant Examiner*—Michael E. Trettel
*Attorney, Agent, or Firm*—Harpman & Harpman

[57] ABSTRACT

A device to transport and move bed ridden patients easily and securely without potential injury to either the patient or the attendant. The device comprises a generally square sheet of flexible fabric material with an integral perimeter handle movable positioned within the fabric.

3 Claims, 4 Drawing Figures

PATIENT MOVER

BACKGROUND OF THE INVENTION

1. Technical Field

This invention relates to patient moving devices that are used in care facilities to move and transport bed ridden or disabled patients.

2. Description of Prior Art

Prior Art devices of this type have relies on a variety of different designs that utilize flexible fabric sheets of material that have handles secured thereto or wherein portions of the fabric sheet itself are used as handles, see for example U.S. Pat. No. 1,334,901, U.S. Pat. No. 3,884,225 and U.S. Pat. No. 4,536,903.

In U.S. Pat. No. 1,334,901 a turning sheet and pad is discloses wherein a pad is formed on the mid-portion of the sheet on which the patient is positioned for moving by gripping the edges of the sheet.

U.S. Pat. No. 3,884,224 discloses a bed patient turn and hold device having a fabric sheet with a portion covered by a fleece cushion with straps extending outwardly from opposite ends. The straps have snaps to form loops that can be fastened around portions of the bed to restrict patient movement within.

U.S. Pat. No. 4,536,903 discloses a device having a sheet of material with a central tab. Straps extend outwardly from opposite ends of said material for moving the patient and also to be fastened on the bed rails once wrapped around the patient. The straps in one form of the invention have inturned support loops from which the straps extend.

SUMMARY OF THE INVENTION

A device to transport and manuever a disabled or bed ridden patient by providing a secure, stable and flexible fabric sheet on which the patient is rolled. An integral one piece continous handle strap extends around the perimeter of the sheet and is only accessible at oppositely disposed strategic locations providing self-adjusting handle length dependent on patient's position and attendants requirements for ease of support and transport.

DESCRIPTION OF THE PREFERRED EMBODIMENT

Figure 1:
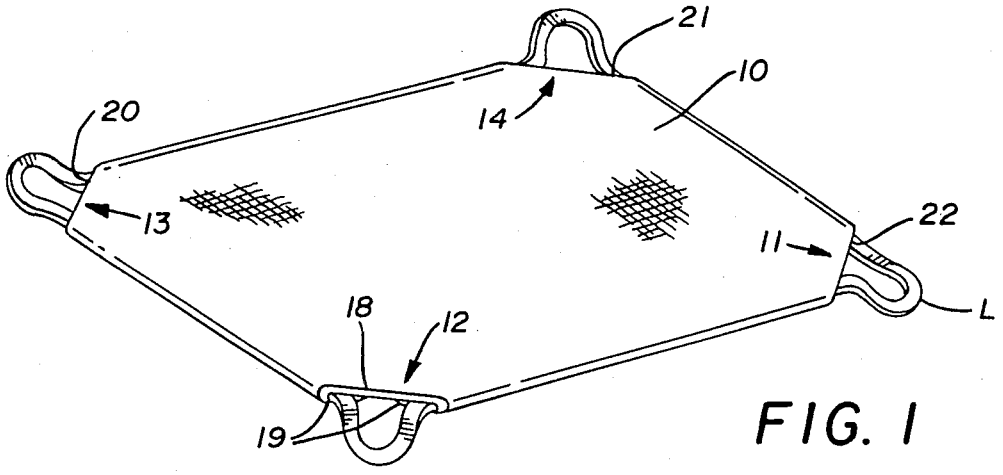
FIG. 1 is a perspective view of the patient moving device with self adjusting hand straps.
Figure 2:
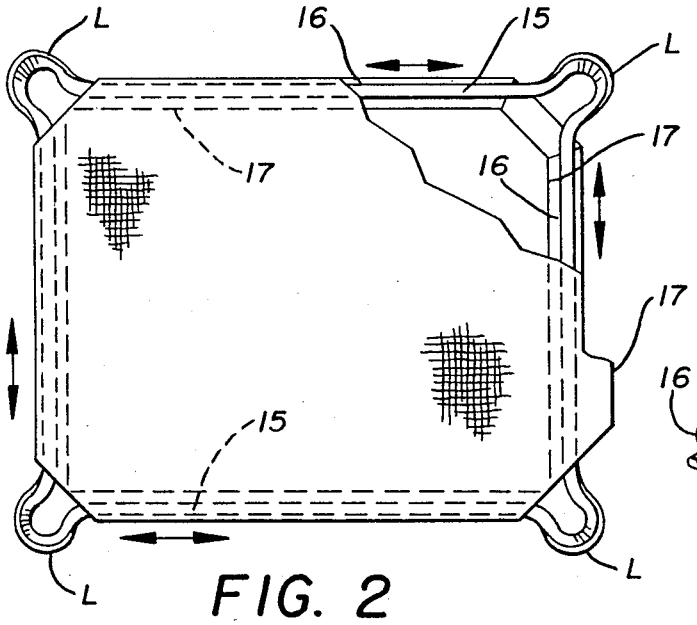
FIG. 2 is a top plan view of the patient moving device with adjustable hand straps.
Figure 3:
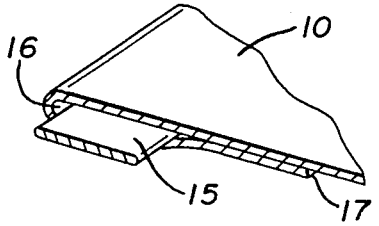
FIG. 3 is an enlarged portion of the patient moving device broken away showing the handle straps relative position.
Figure 4:
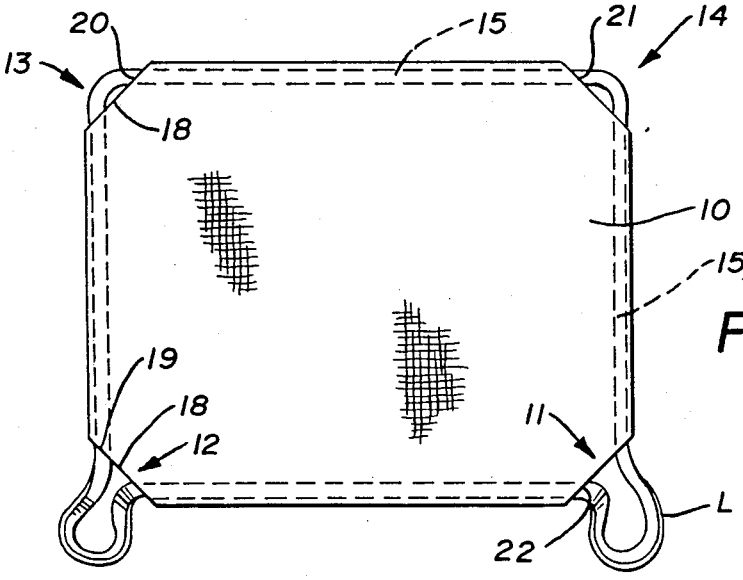
FIG. 4 is a top plan view of the patient moving device with self-adjusting hand straps re-adjusted as if in use.

A patient moving device can be seen in FIGS. 1, 2, and 3 of the drawings comprising a large fabric sheet 10 having a generally rectangular configuration with four corners 11, 12, 13, and 14. The fabric sheet 10 can be of any durable fabric or textured plastic resin material having the required properties of strength, durability, and tactual grip. The fabric sheet 10 chosen for illustration is of a canvas type material well known to those skilled in the art. A handle strap 15 is comprised of a nylon or reinforced fabric mesh material in a continous loop configuration obtained by securing the free ends of the handle strap together by sewing or other appropriate means. The handle strap 15 is positioned around the perimeter edge of the fabric sheet 10 within a channel 16 formed by folding over the edge portion 17 upon itself a sufficient distance and securing same to the fabric sheet 10 by sewing. The four corners 11, 12, 13 and 14 are cut diagonally at 18 so that once the corners 11 through 14 are formed the respective channel ends 19, 20, 21, and 22 are exposed from which the handle strap 15 extends forming a loop L between the channel ends at the respective corners.

It will be evident from the above description that given the relative size of the channels 16 and the width of the handle strap 15 that the same will slide freely within said channel 16 allowing the relative loop size at each corner to vary in relation to the relative position of the other loops in accordance to the overall positioning of the fabric sheet 10.

In use a certain amount of resistance is present between the handle strap 15 and the channel 16 due to the texture of the fabric sheet 10 and the handle strap 15. This resistance is important to fix the relative loop size during use when a patient is being moved. The restriction is enough to position the loop size but yet loose enough to provide for ease of adjustment by the attendants as the patient is lifted and moved within. Additionally once the patient is positioned on the patient mover device and moved it can be left in place for future short term moves thus not requiring the patient to be subjected to multiple lifts with the increased possibility of injury.

Thus it will be seen that a new and useful patient moving device has been illustrated and described and it will be apparent to those skilled in the art the various changes and modifications may be made therein without departing from the spirit of the invention and therefore

I claim:

1. A patient moving device comprising a sheet of fabric material having a perimeter edge with multiple corners, an elongated continuous handle strap of a known width positioned movably around the perimeter edge of said sheet, means for restricting movement of said handle strap to said sheet, loops adjustably positioned at the corners of said sheet, means for automatically adjusting sizes of said loops relative each other.

2. A patient moving device of claim 1 wherein means for restricting movement of said handle strap to said sheet comprises channels formed on the perimeter edge of said sheet between said corners, said channels of a known width greater than said known width of said handle strap.

3. A patient moving device of claim 1 wherein said means for automatically adjusting said loops relative each other comprises increasing and decreasing relative sizes of said loops opposite one another and fixing said sizes by resistance between said handle strap and said channel.

* * * * *